US009272812B2

(12) United States Patent
Shuert

(10) Patent No.: US 9,272,812 B2
(45) Date of Patent: Mar. 1, 2016

(54) OCTAGONAL CONTAINER AND PALLET THEREFOR

(71) Applicant: Lyle Shuert, Birmingham, MI (US)

(72) Inventor: Lyle Shuert, Birmingham, MI (US)

(73) Assignee: Shuert Technologies, LLC, Sterling Heights, MI (US)

( * ) Notice: Subject to any disclaimer, the term of this patent is extended or adjusted under 35 U.S.C. 154(b) by 0 days.

(21) Appl. No.: 14/488,505

(22) Filed: Sep. 17, 2014

(65) Prior Publication Data

US 2015/0083715 A1 Mar. 26, 2015

Related U.S. Application Data

(60) Provisional application No. 61/880,353, filed on Sep. 20, 2013.

(51) Int. Cl.
*B65D 19/18* (2006.01)
*B65D 19/00* (2006.01)

(52) U.S. Cl.
CPC ..... *B65D 19/18* (2013.01); *B65D 19/0097* (2013.01); *B65D 2519/00034* (2013.01); *B65D 2519/00064* (2013.01); *B65D 2519/00159* (2013.01); *B65D 2519/00174* (2013.01); *B65D 2519/00194* (2013.01); *B65D 2519/00208* (2013.01); *B65D 2519/00273* (2013.01); *B65D 2519/00293* (2013.01); *B65D 2519/00323* (2013.01); *B65D 2519/00497* (2013.01); *B65D 2519/00567* (2013.01); *B65D 2519/00651* (2013.01); *B65D 2519/00711* (2013.01)

(58) Field of Classification Search
CPC ..... B65D 19/18; B65D 19/0097; B65D 2519/00159; B65D 2519/00174; B65D 2519/00711; B65D 2519/00323; B65D 2519/00497; B65D 2519/00194; B65D 2519/00293; B65D 2519/00034; B65D 2519/00064; B65D 2519/00273; B65D 2519/00651
USPC ..... 220/1.5; 206/386, 595, 597, 598, 599, 206/600
See application file for complete search history.

(56) References Cited

U.S. PATENT DOCUMENTS

| | | | | | |
|---|---|---|---|---|---|
| 4,550,830 | A | | 11/1985 | Shuert | |
| 4,742,781 | A | | 5/1988 | Shuert | |
| 4,765,252 | A | | 8/1988 | Shuert | |
| 4,856,657 | A | | 8/1989 | Shuert | |
| 4,936,451 | A | | 6/1990 | Shuert | |
| 4,989,731 | A | | 2/1991 | Shuert | |
| 5,133,460 | A | | 7/1992 | Shuert | |
| 5,279,423 | A | | 1/1994 | Shuert | |
| 5,363,963 | A | * | 11/1994 | Allen | 206/425 |
| D380,153 | S | * | 6/1997 | Riddell | D21/392 |
| RE35,875 | E | | 8/1998 | Shuert | |
| 6,003,705 | A | * | 12/1999 | Burguieres, Jr. | 220/1.5 |
| 6,968,946 | B2 | | 11/2005 | Shuert | |
| 7,765,744 | B2 | * | 8/2010 | Herron | E04C 1/395 220/4.28 |
| 2004/0118742 | A1 | * | 6/2004 | Shuert | 206/600 |
| 2005/0196080 | A1 | * | 9/2005 | Stone et al. | 383/119 |

* cited by examiner

*Primary Examiner* — Robert J Hicks
*Assistant Examiner* — Kareen Thomas
(74) *Attorney, Agent, or Firm* — Young Basile Hanlon & MacFarlane, P.C.

(57) ABSTRACT

A shipping container comprising a bottom pallet, a sleeve and a top. At least the pallet and sleeve are octagonal in shape and the pallet has a floor engaging leg for support at each of the eight corners of the pallet. The ninth leg is located at the center of the pallet and all legs are located to allow forklift entry from any of multiple approach directions. The legs are preferably of crescentoid shape.

5 Claims, 7 Drawing Sheets

OCTAGONAL CONTAINER AND PALLET THEREFOR

CROSS-REFERENCE TO RELATED APPLICATION

This application claims the benefit of U.S. provisional patent application Ser. No. 61/880,353 filed Sep. 20, 2013.

INTRODUCTION

This document describes a shipping and/or storage container of octagonal shape including in particular a bottom pallet with legs at each of the eight corners.

BACKGROUND

Three-piece shipping/storage containers are known. Such containers generally comprise a bottom pallet of plastic construction, a plastic top that may be similar to a pallet, and an intermediate sleeve adapted to fit between the pallet and the top and made of corrugated, heavy duty paperboard or plastic or combinations thereof. The typical shape for such a container is square or rectangular and the typical pallet has nine legs, arranged in three rows of three legs each spaced apart so as to allow for forklift entry in any of four directions. The components of the container may be banded together for shipment or held together with slide locks of the type described in my U.S. Pat. No. Re.35,875 issued Aug. 25, 1998, the entire disclosure of which is incorporated herein by reference.

SUMMARY OF THE INVENTION

Described in this document is a shipping/storage container generally of the type described above but having an octagonal shape; i.e., there are eight sides to and eight corners in the bottom pallet and eight contiguous, intersecting walls to the sleeve that fits on the pallet. The pallet has nine legs; however, they are not arranged in three columns or rows of three each, nor are they placed between corners. Rather, a leg is biased at each of the eight corners of the pallet, and a ninth leg is placed in the center of the pallet. This provides substantial advantages. First, by locating the legs at the corners, the load bearing capability of the container is greatly improved and this contributes to stackability, a quality highly prized by companies who use containers for shipping goods. In addition, locating legs at the corners allows for multiple forklift entry points and angles, an advantage that is more fully described hereinafter.

In accordance with a preferred embodiment hereinafter described in detail, the corner legs are of tapered crescentoid shape; i.e., each leg has a convex inner-facing surface and a concave outer-facing surface. The center leg may be of any desired shape as long as it does not inhibit or prevent forklift entry. In the illustrated example, the center leg is a hollow, tapered, eight-sided polygon.

The bottom pallet can be fabricated in any of several ways and from any of several materials; i.e., it may be injection molded using a material such as high-density polyethylene (HDPE) or it may be fabricated using "twin sheet" technology wherein two polypropylene sheets are thermoformed and fused together. In the described embodiment, the sheets are octagonal and are molded so as to define nesting leg portions. In addition, I describe herein a plurality of slide locks, preferably four in number, which are integrated into the bottom pallet and operate in connection with slots formed near the bottom edge of the container sleeve to join the container sleeve to the bottom pallet. Similar slide locks can be used in combination with a top structure. The slide locks are shown here and are more fully described in my Reissue patent as identified above.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying photographs, the latter being briefly described hereinafter.

BRIEF DESCRIPTION OF THE DRAWINGS

This disclosure is to be taken with the accompanying drawing which illustrates in multiple figures an octagonal container comprising a twin sheet bottom pallet, an intermediate octagonal sleeve and a top structure.

DETAILED DESCRIPTION OF THE ILLUSTRATIVE EMBODIMENT

Figure 1:
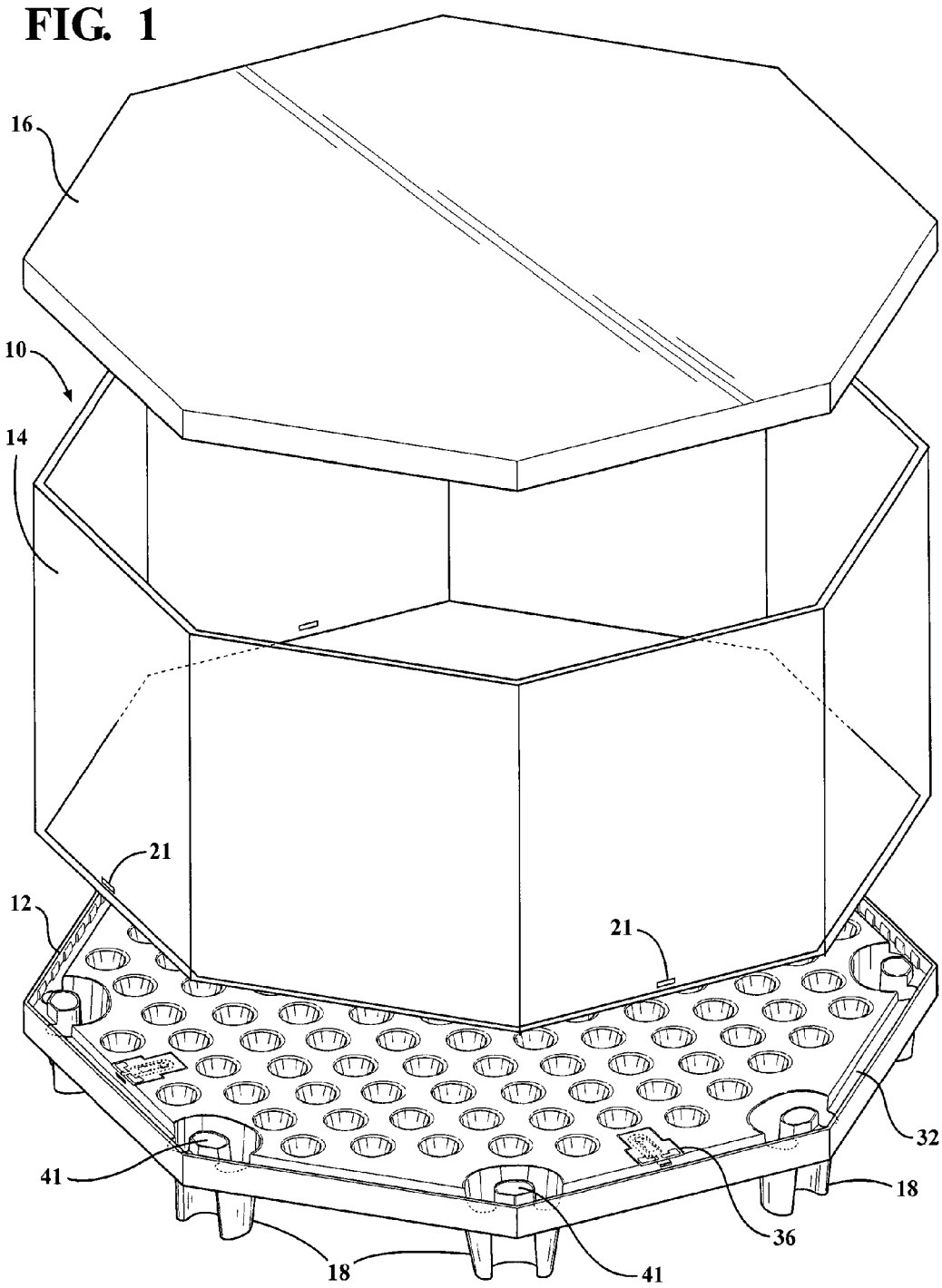
FIG. 1 is a perspective, exploded view of an octagonal container using a bottom pallet with legs at the corners.
Figure 2:
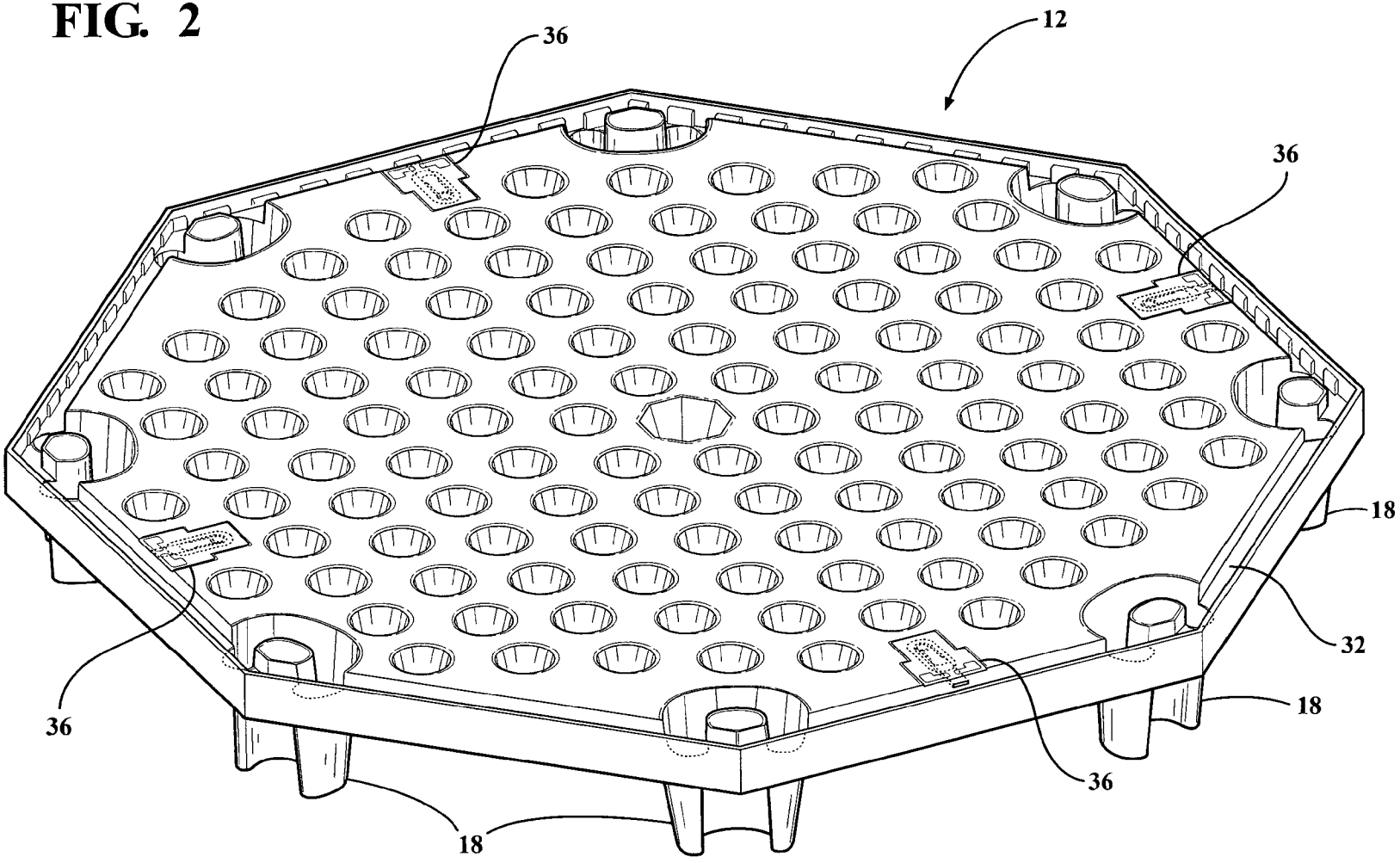
FIG. 2 is a perspective view of the bottom pallet alone.

Referring to the figures, there is shown a three-piece octagonal container 10 comprising a forklift-compatible bottom pallet 12, an intermediate octagonal sleeve 14 having eight contiguous and intersecting planar walls and a molded plastic top 16 which is merely represented in outline and without detail as it may take any of a number of styles and be made with any of a number of fabrication methods and materials. It is preferably of thermoformed twin sheet construction and may have contours such as tapers that promote semi-nested stacking of containers and/or pallets one atop the other.

The sleeve 14, as stated above, has eight corners formed by eight contiguous planar walls and may be fabricated flat of either corrugated material or extruded thermoformed or molded plastic such as polypropylene or polyethylene. The sleeve 14 has eight contiguous straight co-planar bottom edges which fit into a peripheral track or groove 32 in the bottom pallet 12 as hereinafter described. Slots 21 are formed in four alternating walls near the bottom edge to allow the passage of the blades 38 of plastic slide lock structures 36, also hereinafter described in greater detail, as part of the structure of the bottom pallet 12. The tapered crescentoid legs 18 are also shown in the figures, one leg being located at each of the eight corners of the bottom pallet 12 and the ninth leg being located in the center of the pallet such that the pallet admits multi-way forklift entry for lifting and transportation of containers 10 during use as hereinafter explained. The center leg 19 is of tapered, octagonal shape in the example shown.

As partially explained above, locating the crescentoid legs 18 at the corners of the octagonal container improves load bearing quality and stackability. This is due to the facts that the corners of the sleeve 14 have the greatest structural strength as far as vertical load bearing is concerned, and the further fact that placing the legs 18 directly under these corners allows vertical loads to be transferred directly to a floor or to a similar container below in the case of stacked containers.

Figure 3:
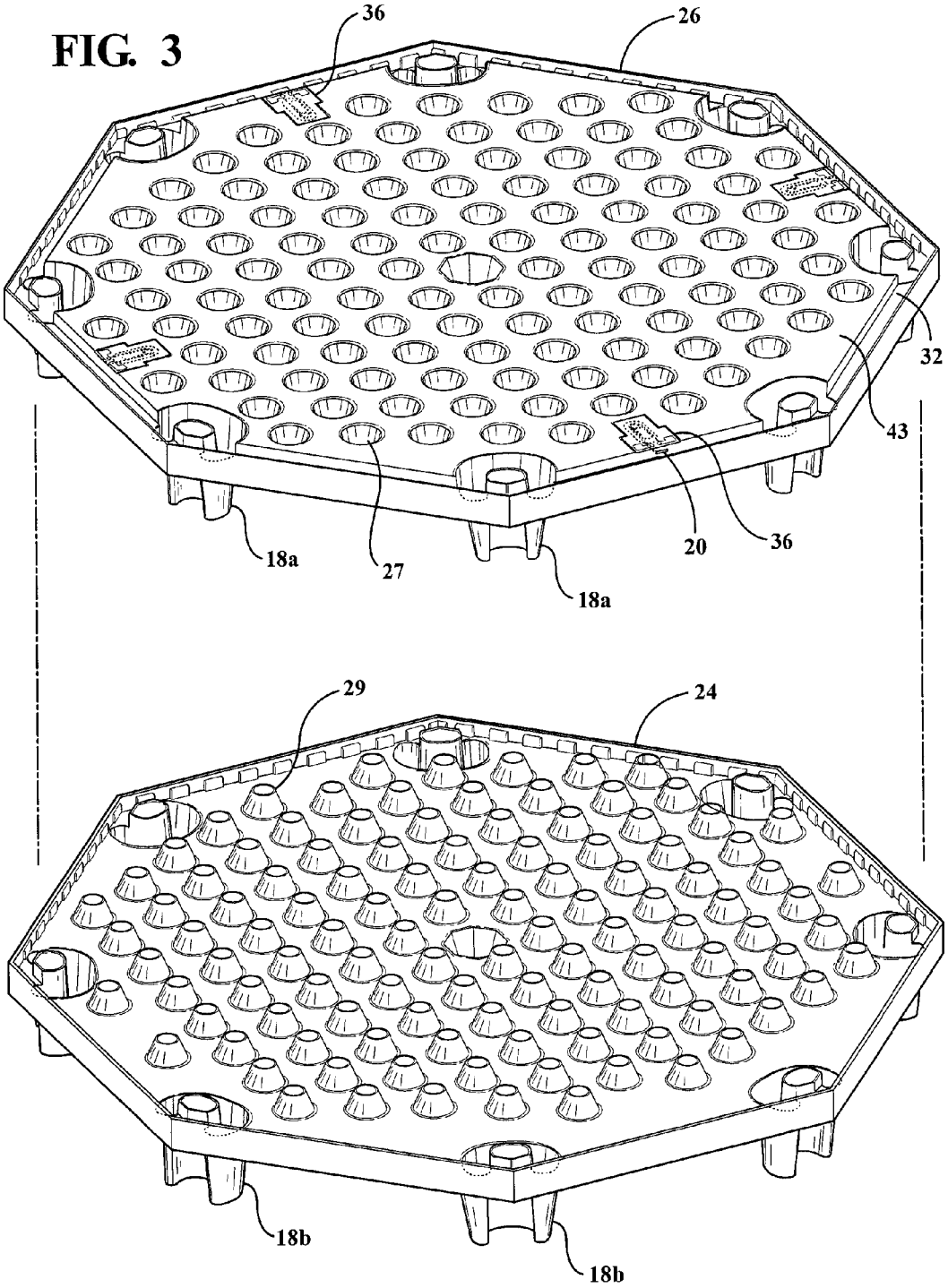
FIG. 3 is a perspective view of the two thermoformed plastic sheets used to fabricate the bottom pallet.

Each bottom pallet 12 comprises a thermoformed bottom sheet 24 and a thermoformed top sheet 26. The sheets are molded with a regular pattern; i.e., rows and columns, of bosses 27, 29 which mate and are fused together when the top and bottom sheets 26 and 24, respectively, are joined together as shown in FIGS. 3 and 8.

Figure 7:
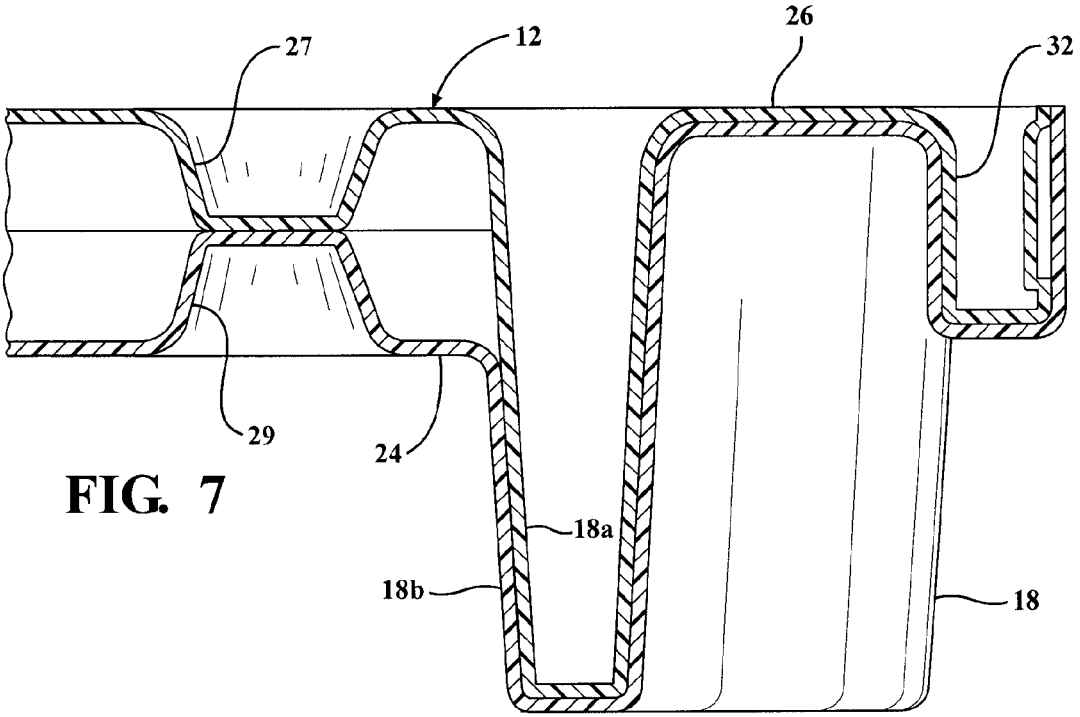
FIG. 7 is a sectional view through a leg.
Figure 8:
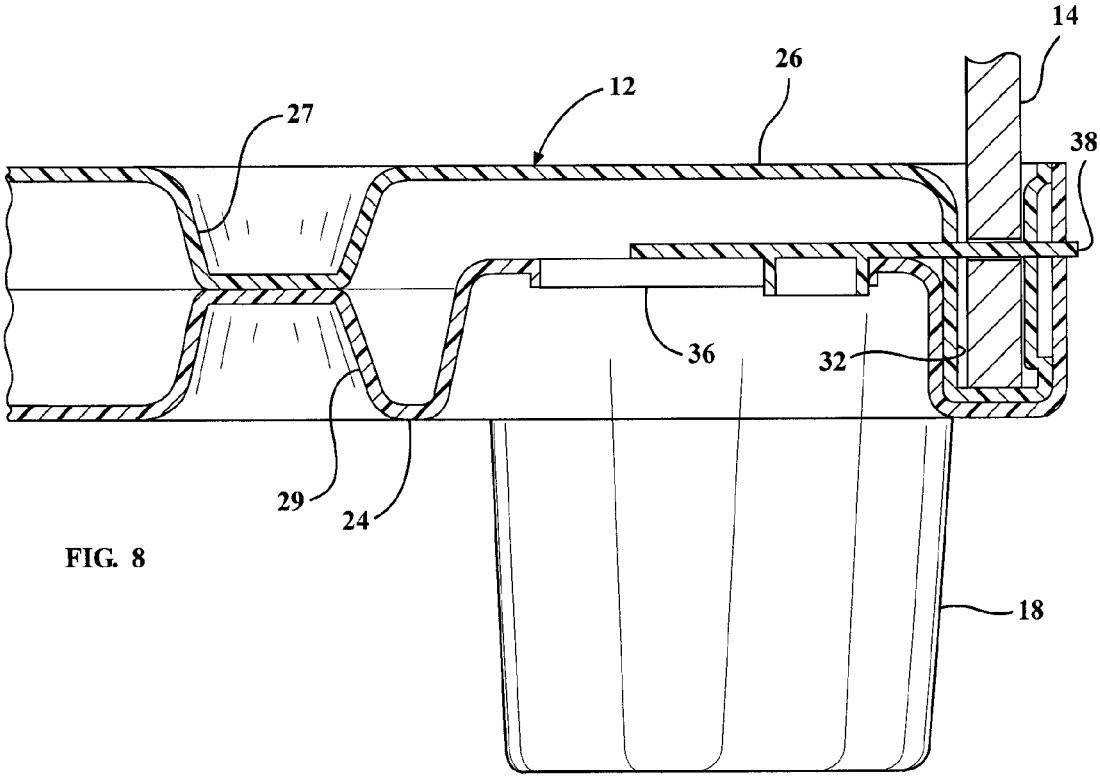
FIG. 8 is another sectional view through a slide latch showing how a sleeve is latched to a bottom pallet.

The top and bottom sheets are also fused around the top edge of the periphery to create a unitary structure as shown in FIGS. 7 and 8. Fusing of the sheets also occurs along the bottom of the track 32.

Focusing now on the crescentoid legs 18, the bottom sheet is thermoformed in a deep draw fashion to produce tapered crescentoid legs, one at each corner of the octagonal sheet with the concave surface being outermost and the convex surface being innermost relative to the center of the pallet. The legs are tapered such that the crescentoid leg 18*a* of the top sheet fits into and is fused to the walls of the bottom sheet crescentoid leg 18*b*. All of the legs adjoin a continuous peripheral slot 32 in the bottom pallet 12 just inside of the vertical peripheral sidewall. Unlike the sleeve shown at 20 in my Reissue patent, the sleeve 14 has straight bottom edges. The slot 32 opens upwardly to receive the bottom edges of the sleeve 14 therein. Slots 20 are formed in the sidewalls of the bottom pallet 12 to receive the blades of side lock structures 36 which are captured between the top and bottom sheets. The locks have "figure-eight" body contours which operate to provide a detent action with latch blades 38 so that each slide lock blade 38 has two stable positions, one drawn into or toward the center of the pallet and one extending outwardly from the center of the pallet such that the blade 38 slides through a slot 21 in the sleeve 14 so as to secure the sleeve 14 to the bottom pallet 12 as shown in FIG. 8. The crescentoid legs 18 are open to the top of the pallet as shown in FIGS. 1, 2, 4 and 6 such that the individual pallets 14 may be stacked and nested one within the other when the container 10 is broken down for return shipment or storage. The combination of the upwardly opening crescentoid legs and the peripheral groove is such as to form bosses 41 at each of the four corners with flat tops generally coplanar with the top load bearing surface 43 of the top sheet 26. The bottom edge of the sleeve fits around the outside of each of the bosses 36 with the general result being that the bosses have the overall shape of an upside down cupcake. The legs and sleeves transmit loads down to the floor or to the top of the next lower container in a stack.

As indicated above, the container is generally assembled by placing a bottom pallet 12 in the desired position and thereafter placing a sleeve 14, assembled into the octagonal shape, into the peripheral groove of the bottom pallet. As stated above, the sleeves are made flat with vertical hinges to allow folding into the octagonal shape. The blades 38 of the slide lock structures 36 are then pushed outwardly to interconnect the sidewalls 14 to the bottom pallet 12. The container may then be loaded thereby exhibiting the advantage to the octagonal structure which, because of the shorter spans of the sidewalls of the sleeve, provides greater resistance to outward bulging when loaded. The top or cap 16 may then be put in place and, if desired, the entire container may be banded in a conventional fashion using steel or plastic straps, depending on the load strength needed. Such constructed and loaded containers may then be lifted using forklift machines of varying fork width and with entry provided in any of at least eight directions. The containers may be assembled into adjacent groups and/or stacked atop one another. If desired, the topography of the top 16 may be structured in such a way as to interact with the legs of another container stacked on top of it to prevent or reduce the tendency for lateral shifting.

Figure 4:
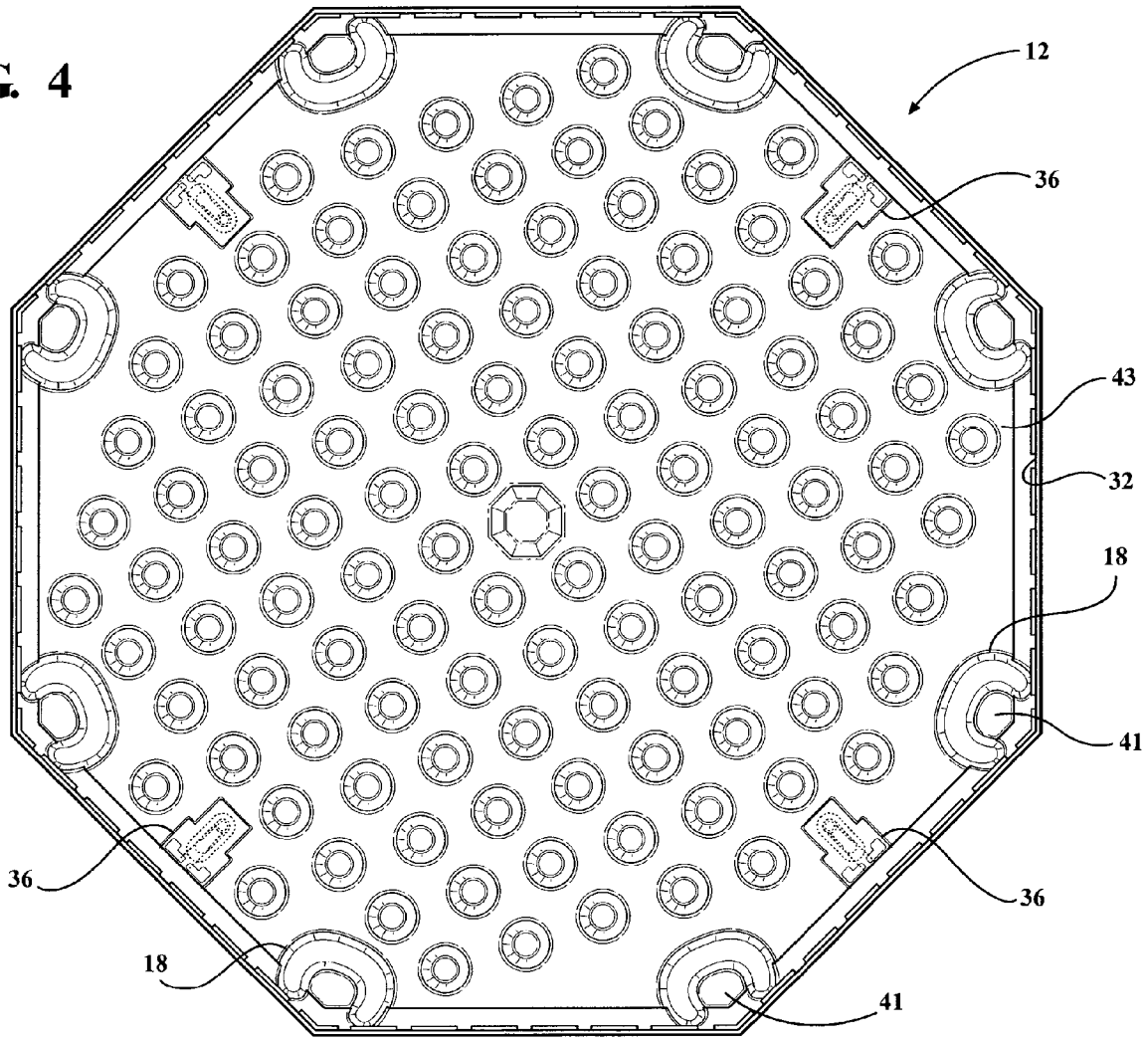
FIG. 4 is a top plan view of the bottom pallet.
Figure 5:
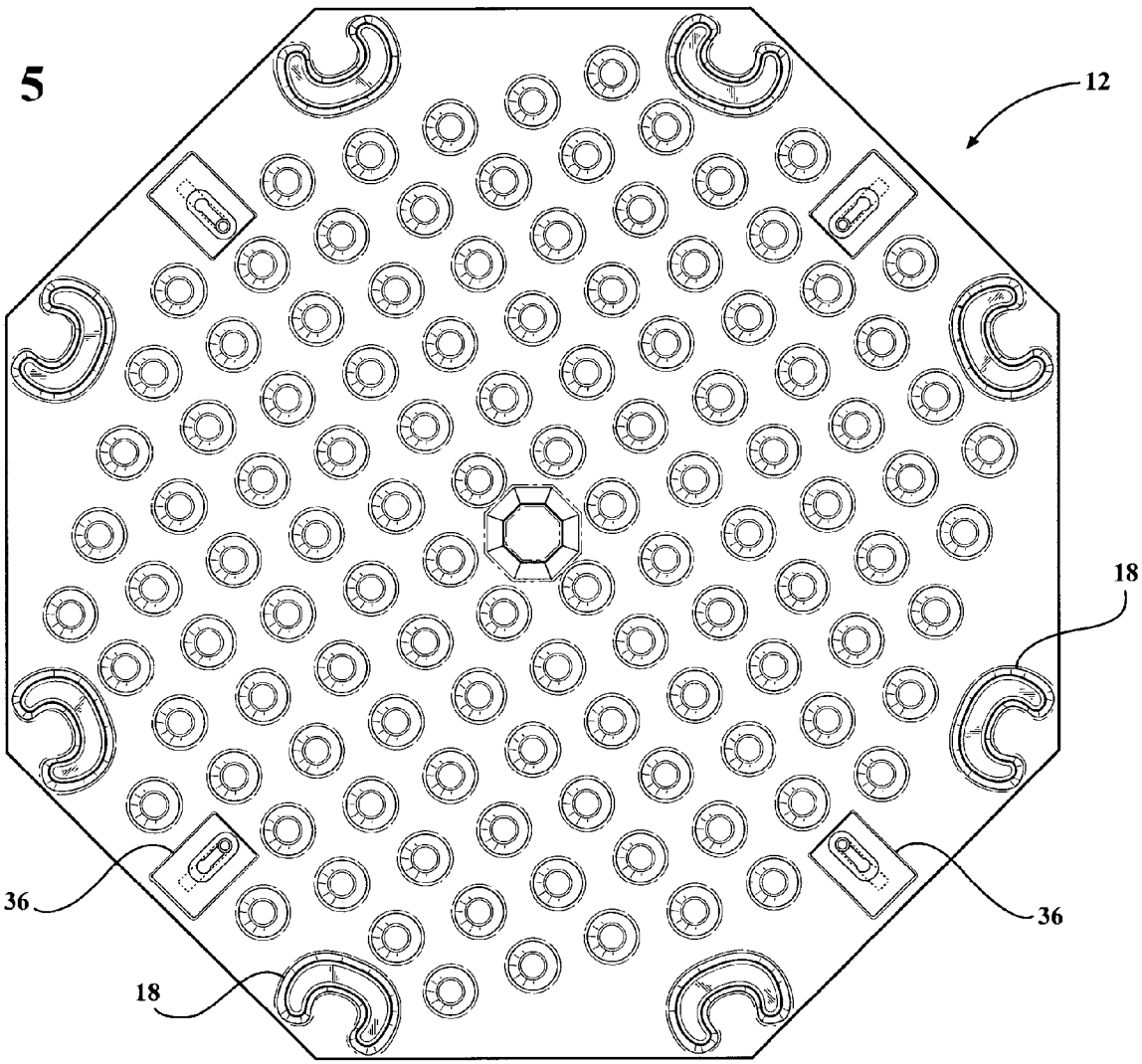
FIG. 5 is a bottom plan view of the bottom pallet.
Figure 6:
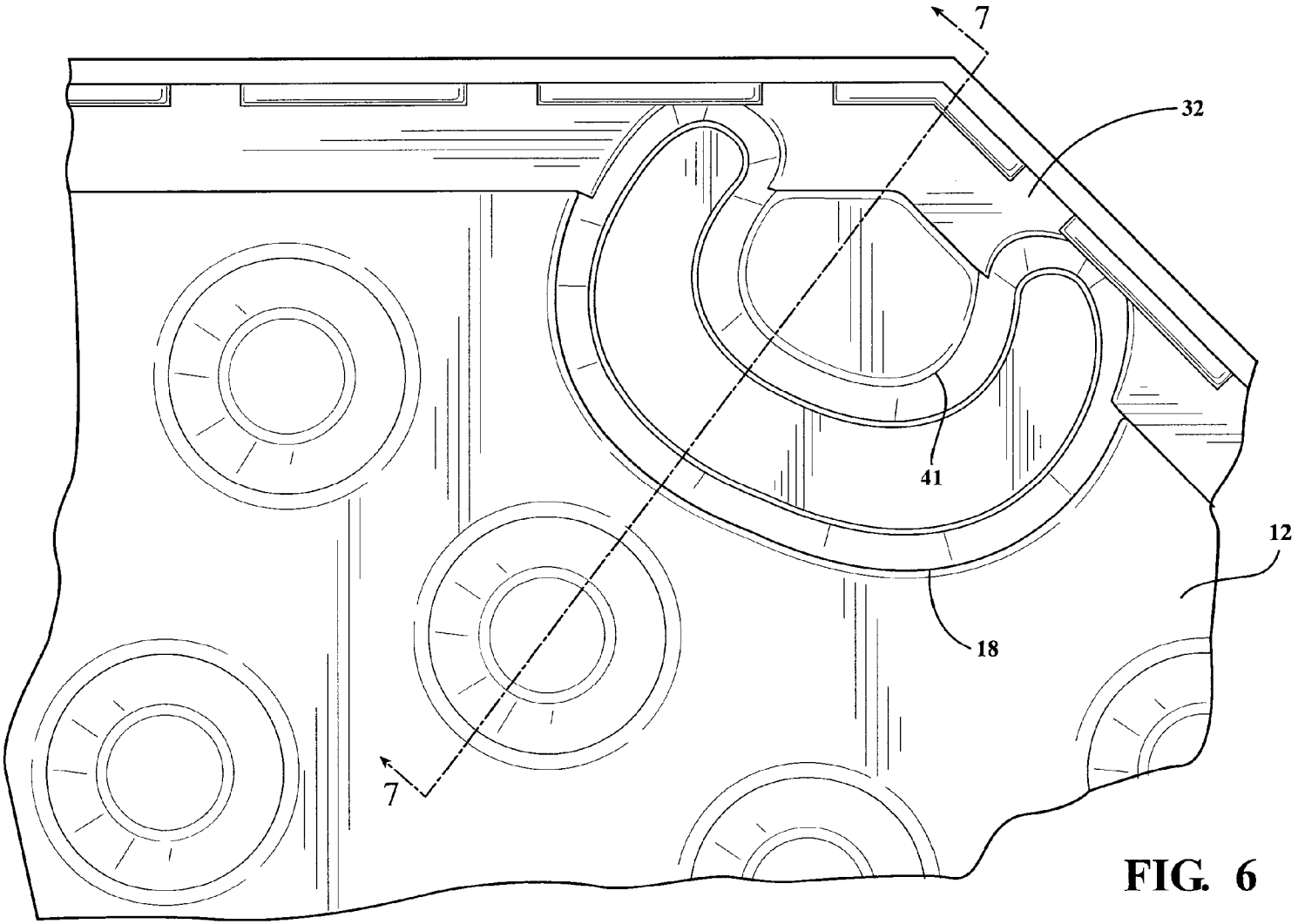
FIG. 6 shows a corner structure in detail.

Looking at FIG. 4, one technique for lifting by forklift is for the forklift machine to approach the pallet perpendicular to a straight pallet side, such that the forklift tangs capture an adjacent pair of legs 18 between them. There are eight possible approach angles using this technique. This allows containers (and pallets 12) to be placed side-by-side on a loading deck. Another technique is for the forklift machine to approach directly at a corner in which case the tangs of the fork capture only one leg 18 between them; this is of advantage for forklift machines with narrow forks. Again, there are eight different approach angles for this technique. Altogether, there are 16 entry angles and at least two ways to load containers 10 in groups.

My invention is characterized by an octagonal bottom pallet of either injection molded or twin sheet construction with legs located at each of the corners of the bottom pallet. I prefer the crescentoid legs with parallel concave and convex outer surfaces as shown and described.

In addition, my invention embraces the concept of using my previously patented slide lock in combination with such an octagonal pallet as well as the use of octagonal sleeves having eight contiguous and generally parallel sidewalls to form a useful and sturdy shipping and storage container. The plastic container may be combined with fire retardant materials and other materials for added strength and durability. The containers may be broken down and the sleeves flattened for storage and/or return shipment such that the containers described herein are susceptible of multiple one-way or two-way uses over a substantially lengthened lifetime, relative to the conventional containers using wooden pallets.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An octagonal plastic pallet for use in constructing a container with eight sides, the pallet having eight contiguously intersecting sides defining eight corners, and eight tapered integrally molded plastic integral legs, one leg being supportingly located under each of the eight corners of the octagonal pallet; said pallet further having a ninth leg supportingly located substantially under a center of said pallet and integral therewith, said pallet further comprising an eight-sided sleeve, and a plurality of slide latches arranged along the sides of said octagonal pallet to lock said sleeve to the bottom pallet by way of slots formed in the side walls of said sleeve.

2. The octagonal pallet described in claim 1 wherein each of the legs is of crescentoid shape with a concave outwardly facing surface and a convex inwardly facing surface.

3. An octagonal pallet as described in claim 1 wherein the octagonal pallet is made of twin sheet construction so as to comprise a top sheet and a bottom sheet fused together.

4. A shipping container comprising:

an eight-walled sleeve wherein each wall has a bottom edge and is substantially identical in height and width to each other wall, the eight walls intersect one another to define eight corners;

the bottom edges lying in a common plane;

a twin-sheet plastic pallet of octagonal shape having eight sides conforming in dimension to the eight walls of the sleeve;

said pallet having a peripheral groove structure that receives said bottom edges therein;

said pallet further having eight corners corresponding geometrically to the eight corners of the sleeve;

said pallet having integrally formed thereon eight legs, each leg being co-located with and substantially directly under a corner of the pallet; each leg being of tapered crescentoid shape so as to define a concave outwardly facing surface; and a top of such shape and size as to be conformingly locatable on the top of said sleeve.

5. The container defined in claim 4 wherein said pallet is constructed of two thermoformed sheets fused together.

* * * * *